US007356961B2

(12) United States Patent
Williams

(10) Patent No.: US 7,356,961 B2
(45) Date of Patent: Apr. 15, 2008

(54) CONFIGURABLE DEVICE FOR CLEANING THE BARREL OF A FIREARM, AND FIREARM CLEANING KIT CONTAINING COMPONENTS OF DEVICE

(75) Inventor: Nicholas Williams, Boonville, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 343 days.

(21) Appl. No.: 11/113,649

(22) Filed: Apr. 25, 2005

(65) Prior Publication Data

US 2006/0236584 A1 Oct. 26, 2006

(51) Int. Cl.
*F41A 29/02* (2006.01)
*B08B 9/02* (2006.01)

(52) U.S. Cl. ..... 42/95; 15/104.16; 15/104.2

(58) Field of Classification Search ..... 42/95; 15/104.16, 104.2
See application file for complete search history.

(56) References Cited

U.S. PATENT DOCUMENTS

| | | | | |
|---|---|---|---|---|
| 2,559,376 | A | 7/1951 | Schnitger | |
| 2,798,238 | A * | 7/1957 | Rogovin | 15/104.16 |
| 2,897,525 | A * | 8/1959 | Goodwin et al. | 15/104.165 |
| 3,064,294 | A * | 11/1962 | Stocking | 15/104.19 |
| 3,208,302 | A | 9/1965 | Lewis et al. | |
| 3,398,417 | A * | 8/1968 | Erwin | 15/104.19 |
| 3,602,935 | A * | 9/1971 | McDonnell et al. | 15/104.09 |
| 3,716,884 | A * | 2/1973 | Lavins | 15/104.16 |
| 4,010,565 | A * | 3/1977 | DiProspero | 42/106 |
| 4,144,609 | A | 3/1979 | Dubs | |
| 4,399,627 | A | 8/1983 | Malesky et al. | |
| 4,503,578 | A * | 3/1985 | McIntyre | 15/104.165 |
| 4,716,673 | A | 1/1988 | Williams et al. | |
| 4,901,464 | A * | 2/1990 | Banoun | 42/95 |
| 5,074,074 | A | 12/1991 | Yeadon | |
| D327,147 | S | 6/1992 | Morghen | |
| 5,171,925 | A | 12/1992 | Mekler | |
| 5,337,505 | A * | 8/1994 | Brown et al. | 42/95 |
| 5,588,242 | A | 12/1996 | Hughes | |
| 5,775,020 | A * | 7/1998 | Baird | 42/95 |
| 5,815,975 | A | 10/1998 | Rambo et al. | |
| 5,836,099 | A * | 11/1998 | Pace et al. | 42/95 |
| 5,871,589 | A | 2/1999 | Hedge | |
| 5,934,000 | A * | 8/1999 | Hayes, Sr. | 42/95 |
| 5,983,550 | A * | 11/1999 | Skaar | 42/95 |
| 6,023,873 | A * | 2/2000 | Baird | 42/95 |
| 6,077,817 | A | 6/2000 | Pomp | |
| 6,154,913 | A * | 12/2000 | Burton | 15/160 |
| 6,378,236 | B1 | 4/2002 | Solberg et al. | |
| RE38,247 | E | 9/2003 | Wickser, Jr. | |
| D480,207 | S | 10/2003 | Marks | |
| 6,630,034 | B1 | 10/2003 | Schnell | |

(Continued)

*Primary Examiner*—Bret Hayes
(74) *Attorney, Agent, or Firm*—Marjama Muldoon Blasiak & Sullivan, LLP

(57) ABSTRACT

Methods and devices are provided for cleaning firearm barrels, including those of military issue firearms, wherein the methods include a step for removing loose materials from within the barrel, a step for dislodging materials not removed during the first removal step, and a step for removing the materials dislodged during the dislodging step, as well as one or more optional cleaning steps to be performed in addition to or in lieu of the other cleaning steps, and wherein the firearm barrel cleaning device can be adapted to have different configurations for use during one or more of the various cleaning steps.

25 Claims, 7 Drawing Sheets

U.S. PATENT DOCUMENTS 6,640,480 B2 11/2003 Williams et al.
6,668,480 B1 12/2003 Riley
6,691,446 B2 2/2004 Graves
6,701,658 B1 3/2004 Brownell
2002/0056219 A1* 5/2002 Solberg et al. ..... 42/95
2003/0136044 A1* 7/2003 Williams et al. ..... 42/95

* cited by examiner

CONFIGURABLE DEVICE FOR CLEANING THE BARREL OF A FIREARM, AND FIREARM CLEANING KIT CONTAINING COMPONENTS OF DEVICE

FIELD OF THE INVENTION

This invention relates to firearm cleaning, and, in particular, to a configurable firearm barrel cleaning device for reliably and efficaciously cleaning a wide variety of firearm barrels, including those of military issue firearms and platform mounted weapon systems, and a kit for containing the components of the cleaning device.

BACKGROUND OF THE INVENTION

A wide range of materials (e.g., carbon, copper, plastic, dirt, snow, mud, soot) inevitably accumulate over time within the barrel of a firearm, and the presence of such materials can moderately to severely compromise the efficacy of a firearm absent proper periodic cleaning of its barrel. For example, the short term build-up of materials within a firearm barrel can undesirably delay the release time of a bullet or other form of ammunition fired from the firearm. Also, materials that remain within a firearm's barrel for a prolonged period of time can cause corrosion or other significant degradation of the firearm's components, thus potentially necessitating expensive repair or replacement of the firearm.

Although the design of firearm cleaning devices has varied over time, they tend to fall into one of two general design categories: rigid devices (as described, e.g., in U.S. Pat. No. 2,559,376 to Schnitger, U.S. Pat. No. 3,208,302 to Lewis et al., U.S. Pat. No. 4,144,609 to Dubs, U.S. Pat. No. 5,815,975 to Rambo et al., and U.S. Pat. No. 6,378,236 to Solberg et al.) and flexible devices (as described, e.g., in U.S. Pat. No. 4,399,627 to Malesky, U.S. Pat. No. 5,871,589 to Hedge, and U.S. Pat. No. 6,630,034 to Schnell). Despite differences in their design, firearm barrel cleaning devices are generally used in similar ways, namely by being inserted within the firearm to loosen or dislodge (e.g., by one or more of brushing, scraping and/or rinsing actions) unwanted materials from within the barrel. The dislodged materials are then removed from the barrel by the cleaning device itself, or through the use of one or more additional devices.

Unfortunately, most known firearm cleaning devices, whether rigid or flexible, have been plagued by one or more drawbacks, including difficulty of use and/or transport, lack of versatility (i.e., inability to clean a wide array of firearms), and inefficacy. The inefficacy problem in particular has become more pronounced as the size, shape, caliber and action of firearms has continued to change and evolve over time. Many traditional firearm barrel cleaning devices cannot satisfactorily clean the barrel of newer, more sophisticated firearms, especially military issue weapons such as the so-called 40 mm series. Consequently, the only current option for effectively and reliably cleaning such firearms may be disassembly and reassembly, which collectively can take several hours. That is an unacceptable time frame under any circumstances, but can be even more problematic, if not life-threatening, within the traditional contexts in which such weapons are used.

Therefore, a need exists for a firearm cleaning device that is easy to use and transport, and that can reliably and effectively clean a wide range of firearm barrels, including those of military issue firearms.

SUMMARY OF THE INVENTION

The present invention meets these and other needs by providing a configurable firearm barrel cleaning device and methods for using the device. The firearm cleaning device includes one or more cable segments and one or more rods to which a plurality of components and/or attachments can be connected individually or in combination in order to configure the device to perform a plurality of cleaning operations. The cable segment(s) and some or all of the components can be stored within a container, e.g., for packaging or sale as a kit.

A firearm barrel cleaning process of the present invention entails a plurality of cleaning steps in order to ensure that unwanted materials are reliably and thoroughly removed from the barrel. According to a currently preferred aspect of the present invention, the cleaning process has a minimum of three steps, wherein the first step applies solvent or other cleaning assistance substance and removes loose materials from within the barrel, the second step dislodges materials not removed during the first step, and the third step removes the dislodged materials.

To form the cleaning device, an arbor is attached to a flexible segment of cable. For the first cleaning step, a beveled cylindrical plug is placed over the stem of the arbor and a patch is placed atop the plug. A cleaning assistance substance is applied to the patch, and then the device is pulled through the firearm barrel in a breech-to-muzzle direction such that loose materials from within the barrel adhere to the patch and move away from the firing and shell discharge mechanisms within the firing chamber. For the second cleaning step, the patch and plug are replaced by one or more brush wheels, which dislodge materials from within the barrel as the device is pulled through the firearm barrel in a breech-to-muzzle direction. The third cleaning step uses the same equipment as the first step, except that no cleaning substance is applied to the patch and either a new patch is used or a previously unused surface of a previously used patch is utilized. During the third cleaning step, the materials dislodged during the second cleaning step adhere to and are thus removed by the patch.

Once the three cleaning steps have been performed, the level of cleaning that has occurred is assessed in order to determine whether any or all of the cleaning steps should be repeated. This assessment is made visually either via the aided or unaided eye. If it is determined that additional cleaning is required, then any or, as is currently preferred, all of the cleaning steps may be repeated one or more times.

The cleaning process also can entail other cleaning steps, which can be performed in addition to or in lieu of the earlier steps. For example, one or more additional cleaning steps can be performed as spot cleaning in lieu of or to postpone performing the earlier cleaning steps, or as supplemental cleaning prior to, during and/or following the earlier cleaning steps. To perform these other cleaning steps, one or more components or attachments (e.g., one or more brush, pick, scraper) are connected either to a cable segment or to a rod, which, in turn, can be connected to one or more additional rods for added length.

Some or all of the various components that are utilized to form the configurable cleaning device of the present invention can be stored, packaged and/or offered for sale as a kit. The kit components are generally contained within a portable, lightweight case, which can be easily carried by a firearm user.

Due to the configurability of the cleaning device of the present invention, it can reliably and effectively clean a wide variety of firearms, including military issue firearms (e.g., the 40 mm series). The term "firearm," as used herein, refers to a weapon that is capable of firing a projectile therefrom. Examples of firearms for purposes of this invention include, but are not limited to, guns, handguns, shotguns, machine guns, rifles, assault rifles, revolvers, derringers, pistols, machine pistols, and small canons, wherein such weapons are considered firearms for purposes of this invention whether or not they are carried by a user or are mounted onto something (e.g., an aircraft, a tank, a foundation) for use. Firearms for purposes of this invention can have any caliber, including a caliber above or below 0.50 caliber, and can have any type of action, including, but not limited to single action, double action, pump action, bolt action, lever action, automatic or semi-automatic action.

Still other aspects, embodiments and advantages of the present invention are discussed in detail below. While the particular embodiment of this patent is directed to devices for the cleaning and maintenance of 40 mm series weapons, persons skilled in the art would appreciate that the invention is easily adapted to clean and maintain other size firearms by varying the dimensions of the respective components.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION

The present invention provides a firearm cleaning device. The device includes one or more cable segments and one or more rods to which a plurality of components and/or attachments can be connected individually or in combination in order to configure the device to perform a plurality of cleaning operations on a wide range of firearm barrels, including those of military issue firearms. The cable segment(s), the rod(s) and some or all of the components can be stored within a container for packaging/sale as a kit.

A firearm barrel cleaning process of the present invention entails a plurality of cleaning steps in order to ensure that unwanted materials are reliably and thoroughly removed from the barrel. According to a currently preferred embodiment of the present invention, the cleaning process has a minimum of three steps, wherein the first step applies solvent or other cleaning assistance substance and removes loose materials from within the barrel, the second step dislodges materials not removed during the first step, and the third step removes the dislodged materials.

Figure 1:
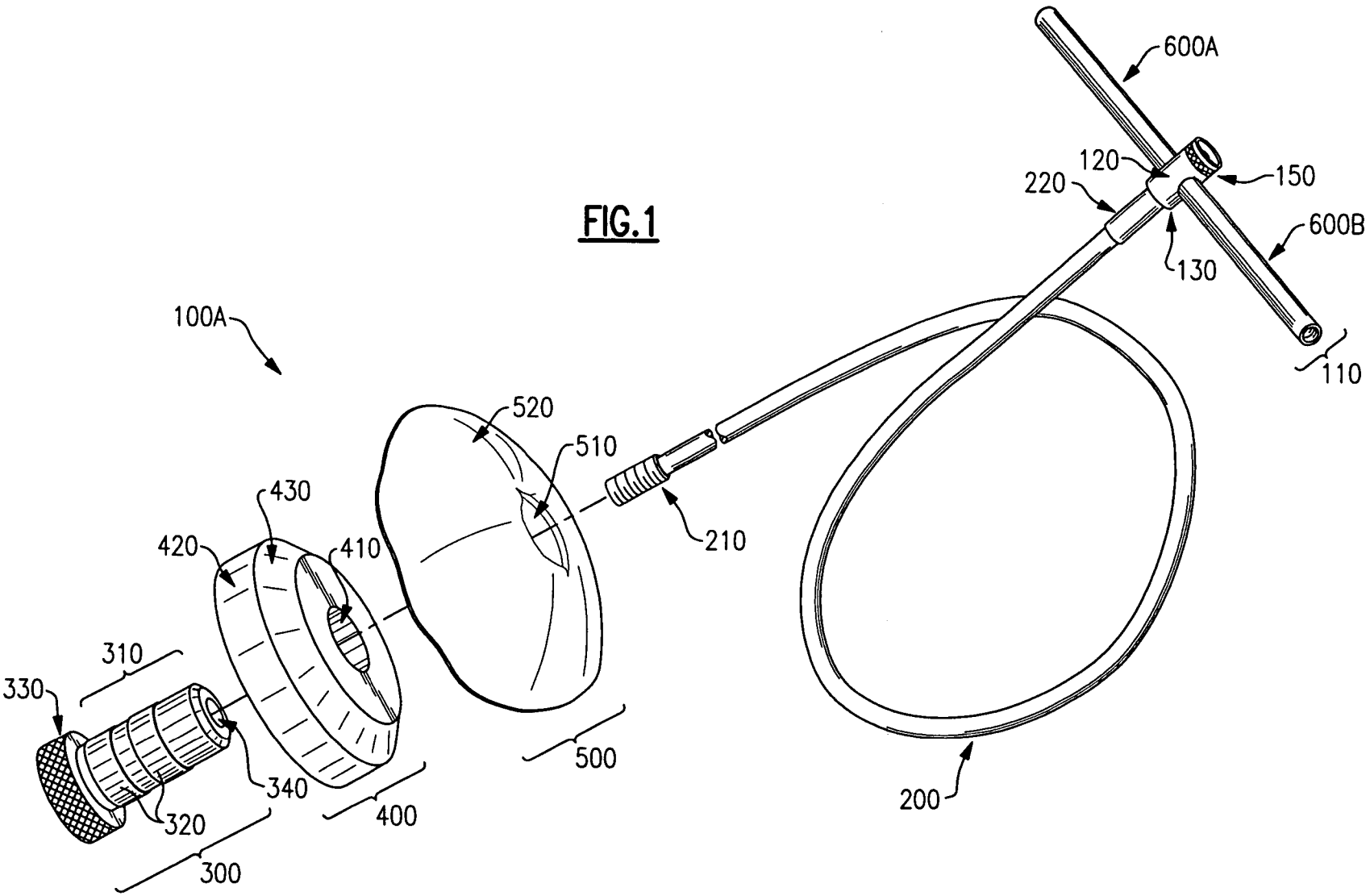
FIG. 1 is an exploded view of the components that form a firearm cleaning device for use in accordance with the first and third cleaning steps of an exemplary embodiment of the present invention.
Figure 3:
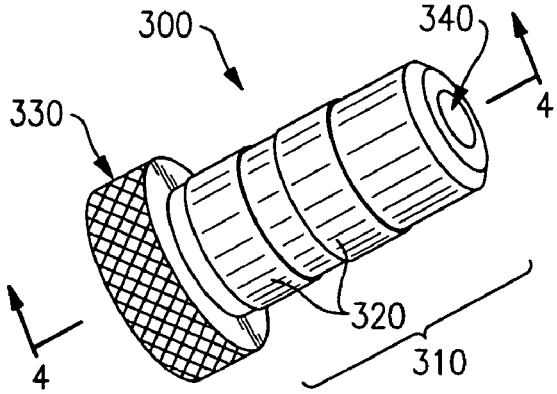
FIG. 3 is a perspective view of an arbor component of the firearm cleaning device of the present invention.
Figure 4:
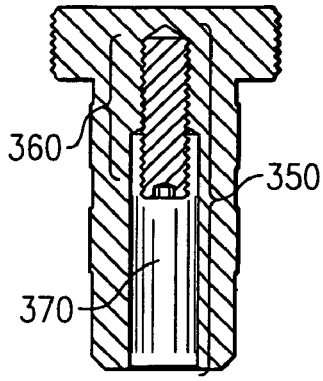
FIG. 4 is a cross-sectional, front view of the arbor component of FIG. 3 taken along line 4-4.

FIG. 1 depicts the components that form a cleaning device 100A in accordance with a first cleaning step of the present invention, namely a cable segment 200, an arbor 300, a generally cylindrical plug 400, and a patch 500. The cable segment 200 has two ends 210, 220, to which one or more components can be reversibly yet reliably connected. As shown in FIGS. 3 and 4, and in an exemplary embodiment of the present invention, the arbor 300 has a generally cylindrical stem 310 with an open end 340 and with one or more flanges 320 extending therefrom. The other end 330 of the arbor 300 also is generally cylindrical and has a diameter larger than that of the stem 310. Optionally, and as shown in FIGS. 1, 1A, 2, 3 and 8, the cylindrical end 330 of the arbor can be textured (e.g., knurled) for ease of handling.

Figure 8:
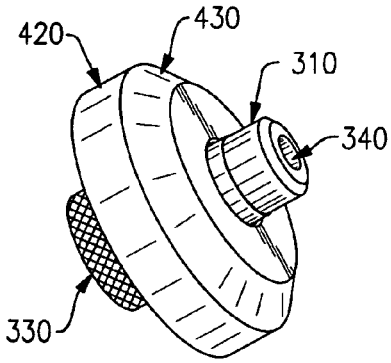
FIG. 8 is a perspective view of the arbor component of FIGS. 3-4 having been fitted with the plug component of FIGS. 6 and 7.

The generally cylindrical plug 400 has an opening 410 defined therein that is sized to enable the plug to fit over the stem 310 of the arbor 300 as shown in FIG. 8. The diameter of the opening 410 should be large enough to fit over the stem 310, yet small enough such that the presence of the flange(s) 320 maintains contact between the plug 400 and the arbor 300 during the cleaning process.

Once the plug 400 is in place, the patch 500 is positioned over the arbor stem 310. As shown in FIG. 1, the patch 500 has an opening 510 to enable it to fit over the stem 310 of the arbor 300 and to rest atop the plug 400. Optionally, and as described in U.S. Pat. No. 4,716,673 to Williams et al. (the entirety of which is incorporated by reference herein), the stem 310 can be slotted, wherein the patch 500 can be fed through the slot for use.

Figure 7:
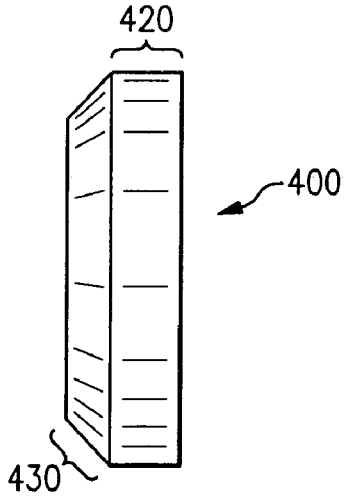
FIG. 7 is a side view of the plug component of FIG. 6.

As shown in FIGS. 1 and 7, and as is currently preferred, the plug 400 has a substantially cylindrical portion 420 that rests against the cylindrical end 330 of the arbor 300, and a beveled portion 430 with which the patch 500 is in communication. The beveled or frustro-conical shape of portion 430 helps maintain alignment of the device 100A within the barrel, thus reducing the possibility of the device becoming stuck within the barrel; the beveled shape also helps maintain contact—between the patch 500 and the plug 400 as well as the patch and the barrel walls—during the cleaning process.

To continue assembly of the cleaning device 100A, the arbor 300 is connected to the cable segment 200 by reversibly yet reliably attaching the end 210 of the cable segment to the end 340 of the arbor. In a currently preferred embodiment of the present invention, the end 340 of the arbor 300 has an opening into which the end 210 of the cable segment 200 is inserted to enable connection. As shown in FIG. 4, the arbor 300 includes an internal bore 350 having a threaded portion 360 and a non-threaded portion 370 to connect (e.g., threadedly connect) the arbor to the cable segment 200. It will be understood by those of ordinary skill in the art that the arbor 300 and the cable segment 200 can be reliably and reversibly attached in other ways (e.g., snap fitting) as well.

Figure 1A:
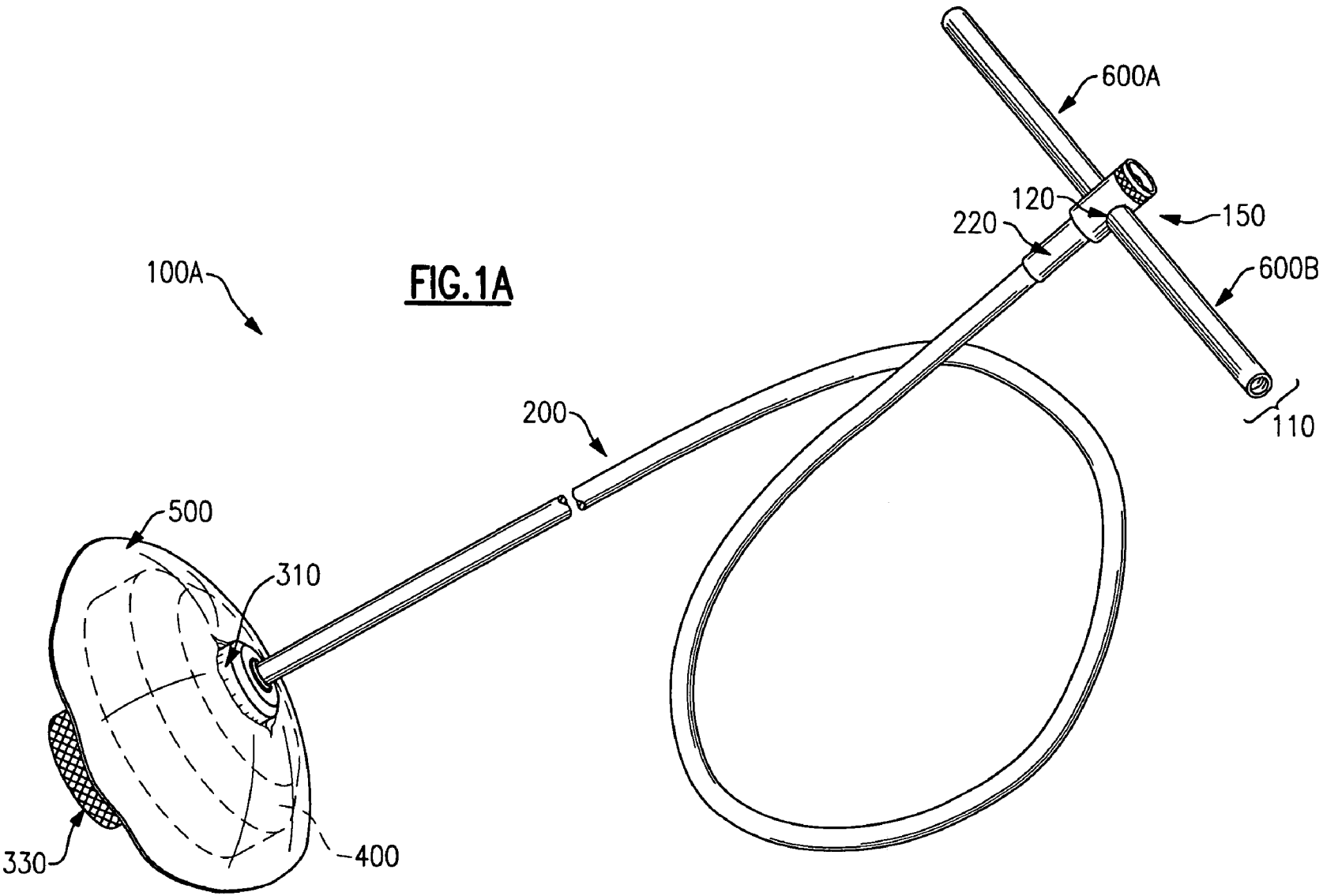
FIG. 1A is a perspective view of the device of 1A as assembled.

FIG. 1A depicts the assembled cleaning device 100A for use in the first cleaning step. As assembled, the cleaning device 100A may include a handle 110 to facilitate the cleaning process. To form the handle 110, a first end 130 of a centerpiece 120 (see FIG. 14) is reversibly yet reliably connected to the other end 220 of the cable segment 200. According to a currently preferred embodiment of the present invention, the centerpiece 120 has a threaded stem 130 at its first end for threaded attachment to a threaded bore within the end 220 of the cable segment 200. It will be understood by those of ordinary skill in the art that the centerpiece 120 and the cable segment 200 can be reliably and reversibly attached in other ways (e.g., snap fitting) as well.

Figure 14:
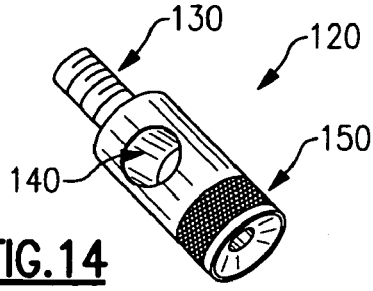
FIG. 14 is a perspective view of a centerpiece component for use with a firearm cleaning device of the present invention.
Figure 15:
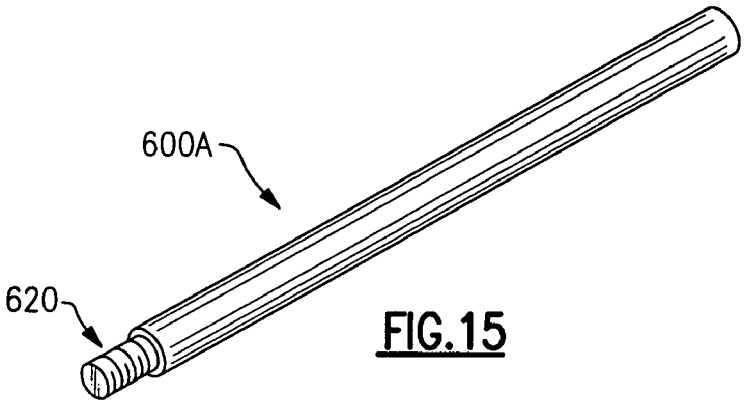
FIG. 15 is a perspective view of a male rod component for use with a firearm cleaning device of the present invention.
Figure 16:
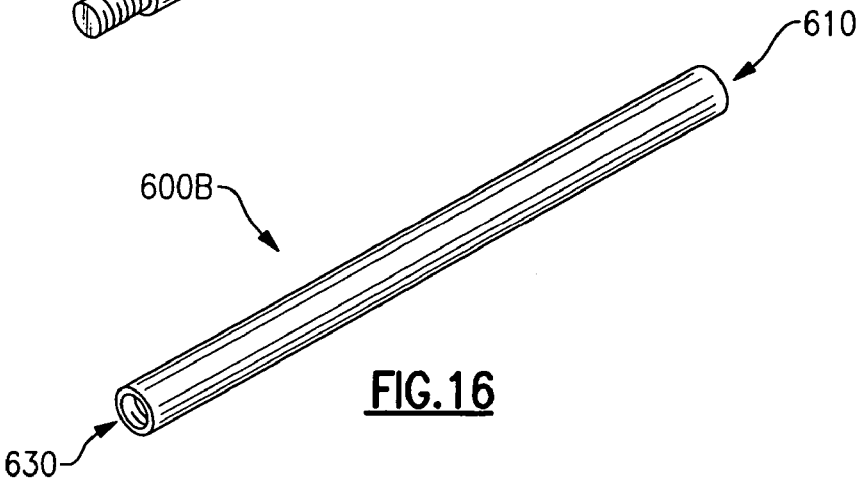
FIG. 16 is a perspective view of a female rod component for use with a firearm cleaning device of the present invention.
Figure 17:
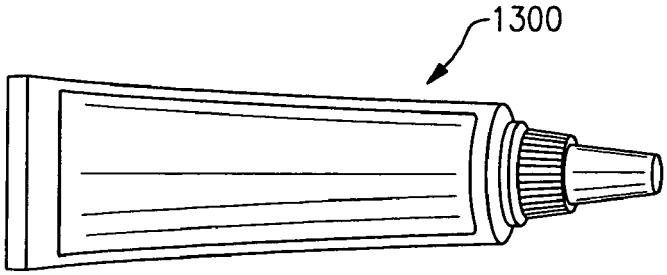
FIG. 17 is a side view of a container for containing a substance for use in connection with a firearm cleaning device of the present invention.

The centerpiece 120 preferably has a smooth transverse bore 140 (see FIG. 14) defined therein and a second end 150, which, as shown in FIGS. 1A and 14, can be textured (e.g., knurled). To form the handle 110, one or more rods 600 can be inserted within the bore 140 of the centerpiece 120. As shown in FIG. 1A, a male rod 600A (FIG. 15) and a female rod 600B (see FIG. 16) have been attached to each other (e.g., via a threaded connection) to form the handle. If the handle is to be formed from only one rod, it is preferable that the rod be a female rod 600B since it has no protruding ends. Either or both of the rods 600A, 600B of FIGS. 15 and 16 can be used during other steps of the cleaning process of the present invention, as will be described in detail below Once the cleaning device 100A is completely assembled, it is ready for insertion into a firearm. However, it is currently preferred to place a predetermined quantity of a solvent or other cleaning assistance substance onto the exposed surface 520 of the patch 500 prior to commencing the insertion process. The cleaning assistance substance can be contained within a tube or other container 1300 (see FIG. 17), which can be included within a kit as will be described below. The specific choice of cleaning assistance substance can vary; however, it should be selected so as to maximize the ability of the patch to remove loose materials from within the firearm barrel. It is currently preferred that the cleaning assistance substance be at least partially polymeric. According to a currently more preferred embodiment of the present invention, the cleaning assistance substance is a polytetrafluoroethylene-based (PTFE-based) polymer that acts as a solvent, a lubricant and a rust inhibitor. An example of a suitable cleaning assistance substance is Otis Bore Solvent CLP, which is commercially available from Otis Products Inc. of Lyons Falls, N.Y. To facilitate the efficacy of the cleaning assistance substance, it should be applied onto the patch surface 520 within temporal proximity (i.e., within a few seconds) of insertion of the device 100A within the firearm.

Insertion of the device 100A commences by introducing the end 220 of the cable segment 200 into the chamber of the firearm (not shown). The cable segment 200 is advanced through the firearm in a breech-to-muzzle direction (i.e., through the chamber, shoulder, neck and barrel) until the end 220 emerges from the firing end of the barrel. According to a currently preferred embodiment of the present invention, the centerpiece 120 is attached to the end 220 of the cable segment prior to the insertion of the device 100A within the firearm, since that will allow the centerpiece to assist in unblocking any obstructions within the firearm barrel.

Once the second end 220 of the cable segment has emerged from the firearm, the handle 110 can be formed as described above. The handle 110 is used to pull the cleaning device 100A through the firearm barrel in a breech-to-muzzle direction to cause the patch 500 to clean the barrel. It is currently preferred to apply a predetermined torsional force the device 100A (e.g., by rotating or twisting the handle 110) as the device is being pulled through the barrel, since doing so will cause added cleaning (i.e., will cause the patch 500 to pick up more loose materials).

Once the device 100A is completely withdrawn from the barrel, the assembly process is reversed such that the device can be subsequently reconfigured to perform the second cleaning step of the cleaning process in which the cleaning device dislodges materials from within the firearm barrel.

Figure 2:
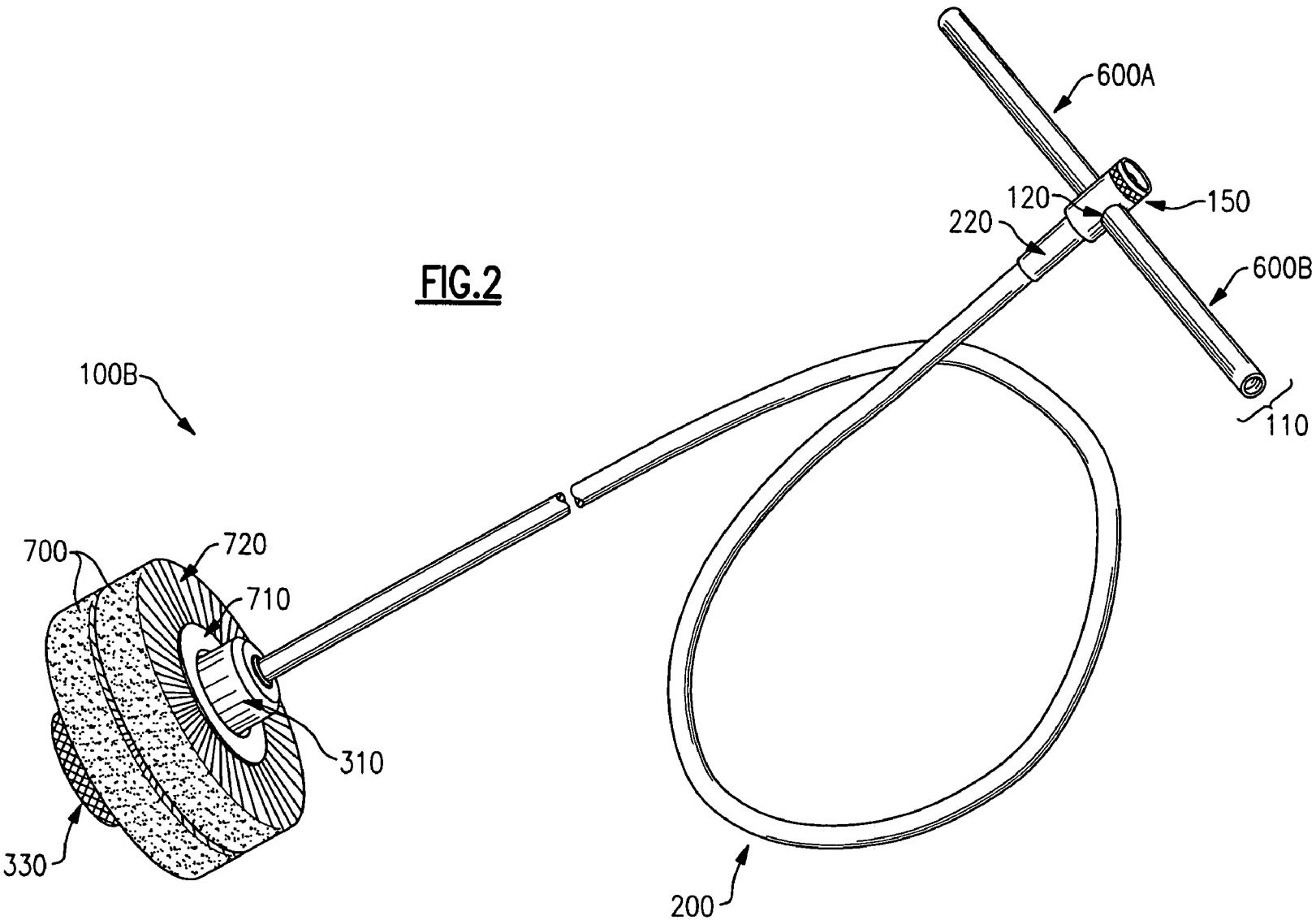
FIG. 2 is a perspective view of an a firearm cleaning device for use in accordance with the second cleaning step of an exemplary embodiment of the present invention.
Figure 5:
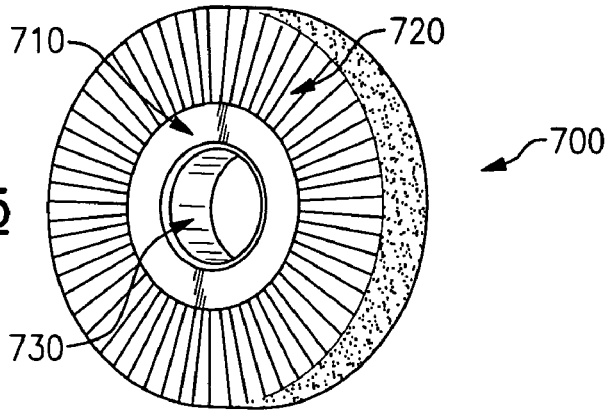
FIG. 5 is a perspective view of a brush wheel (rotary brush) component of the firearm cleaning device of the present invention.
Figure 6:
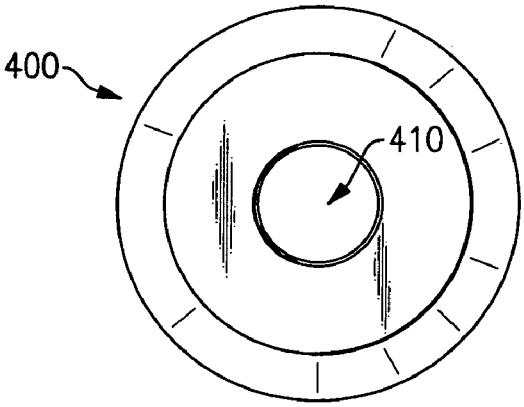
FIG. 6 is a front view of a beveled cylindrical plug component of the firearm cleaning device of the present invention.

FIG. 2 depicts the assembled second version of the cleaning device 100B for use in the second cleaning step of the present invention. To form the device 100B in FIG. 2, one or more brush wheels or rotary brushes 700 are placed in communication with the arbor 300. As shown in FIG. 5, a brush wheel 700 is comprised of a grommet 710 from which a plurality of bristles 720 extend to form a rotary brush shape. The grommet opening 730 of each brush wheel 700 is fed over the stem 310 of the arbor 300. The presence of the flange(s) 320 of the arbor 300 helps keep each brush wheel 700 in place during the cleaning process In an alternative embodiment of the invention, any independent rotation of the brush wheel 700 and the arbor 300 can be limited or prevented by the presence of a keying feature (not shown) on the inner surface of the grommet 710 and the outer surface stem of the of the arbor 300. For example, a protrusion on the inner surface of the grommet may be dimensioned to fit within a longitudinal groove on the outer surface of the stem of the arbor.

As indicated in FIG. 2, the cleaning device 100B can include a plurality of (e.g., two) brush wheels 700. The specific number of brush wheels 700 that are utilized to form the device 100B can vary depending on a variety of factors, including, but not limited to, the type of firearm being cleaned and the level of cleaning that is desired. If a higher level of cleaning is desired, then it is currently preferred to utilize more than one brush wheel 700 to form the device 100B. The number of flanges 320 on the arbor 300 is generally equal to or greater than the number of brush wheels 700 that are to be utilized.

Once the brush wheel or wheels 700 have been put in place, the arbor 300 is attached to the cable segment 200 as described above with respect to the first cleaning device 100A. If desired, and as shown in FIG. 2, a handle 110 can be formed using the techniques and components described above with respect to the first cleaning device 100A. To enable insertion of the second cleaning device 100B, the handle 110 should not be formed prior to insertion of the device within the firearm; however, it is currently preferred to attach the centerpiece 120 to the cable 200 prior to insertion, for the reasons discussed above.

As with the device 100A of FIGS. 1 and 1A, insertion of the device 100B occurs by introducing the end 220 of the cable segment 200 into the chamber of the firearm (not shown). The cable segment 200 is advanced through the firearm in a breech-to-muzzle direction (i.e., through the chamber, shoulder, neck and barrel) until the end 220—with attached centerpiece 120—emerges from the firing end of the firearm. Once that has occurred, the handle 110 can be formed as described above. The handle 110 is used to pull the cleaning device 100B in a breech-to-muzzle direction to cause the brush wheel(s) 700 to clean the barrel. It is currently preferred to apply a predetermined torsional force the device 100B (e.g., by rotating or twisting the handle 110) as the device is being pulled through the barrel, since doing so will cause added cleaning (i.e., will cause the brush wheel(s) 700 to dislodge additional materials).

Once the device 100B is removed from the firearm barrel, the assembly process is reversed such that the device can be reconfigured for the third cleaning step in which the cleaning device removes materials dislodged during the second cleaning step. To perform the third cleaning step, and according to a currently preferred embodiment of the present invention, the cleaning device is configured and utilized identically to the device 100A depicted in FIGS. 1 and 1A, with two exceptions. First, either a new patch 500 is used or a previously used patch is re-used but placed on the plug 400 such that a fresh (i.e., previously unused) surface 520 will contact the barrel during the cleaning process. This will promote the cleaning efficacy of the patch 500 and will reduce throat erosion. Second, no cleaning assistance substance is added to the patch 500 for the third cleaning step, since doing so could cause the dislodged dirt to re-adhere to the firearm barrel.

Figure 9:
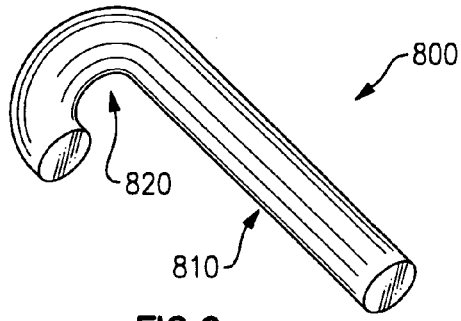
FIG. 9 is perspective view of a bore reflector component for use with a firearm cleaning device of the present invention.

After completion of the third cleaning step, it is currently preferred to assess the level of cleaning that has occurred in order to determine whether any or all of cleaning steps one, two and/or three should be repeated. This assessment can be made visually in one of two ways—through use of an aiding instrument (e.g., a bore reflector 800 as shown in FIG. 9) that enables one to see more easily into the firearm barrel, or by unaided visual inspection of the barrel and/or the patch 500 upon withdrawal of the device from the barrel following the third step of the cleaning process. If it is determined that more cleaning is required, then any, or, as is currently preferred, all of cleaning steps one, two an three may be repeated one or more additional times.

The cleaning process also can entail other cleaning steps, which can be performed in addition to or in lieu of those described above. For example, one or more additional cleaning steps can be performed as spot cleaning in lieu of or to postpone performing the cleaning steps described above, or as supplemental cleaning prior to, during and/or following the previously described cleaning steps.

To perform these other cleaning steps, one or more components or attachments are connected (e.g., via a threaded connection) either to an end 210, 220 of the cable segment 200 or, as is currently preferred, to a first end 610 of a female rod 600B (see FIG. 15) in order to form a cleaning device 100C, 100D, . . . 100*x*. To provide added length to the device 100*x*, and as is currently preferred, a male end 620 of a male rod 600A (see FIG. 15) can be attached to the other end 630 of the female rod, e.g., as shown in FIGS. 18 and 19.

Figure 10:
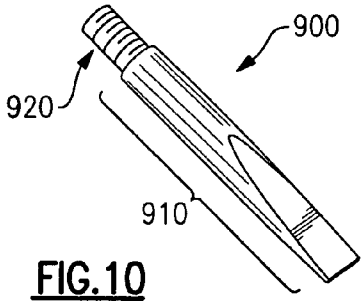
FIG. 10 is a perspective view of a scraper attachment for use with a firearm cleaning device of the present invention.
Figure 11:
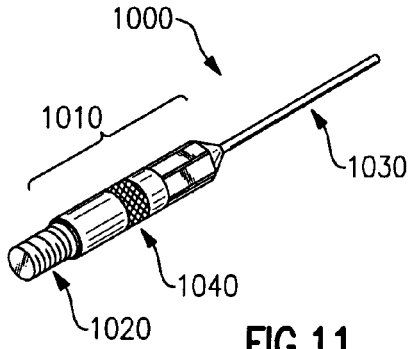
FIG. 11 is a perspective view of a pick attachment for use with a firearm cleaning device of the present invention.
Figure 12:
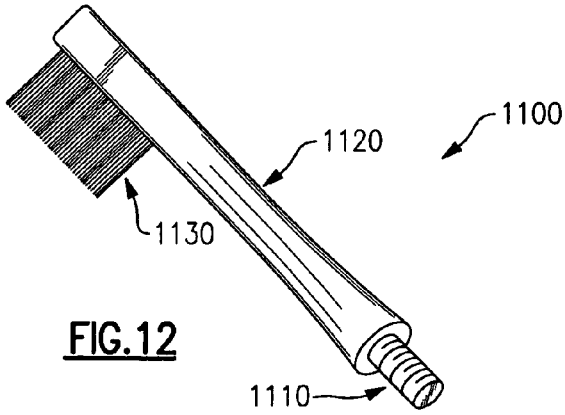
FIG. 12 is a perspective view of a side brush attachment for use with a firearm cleaning device of the present invention.
Figure 13:
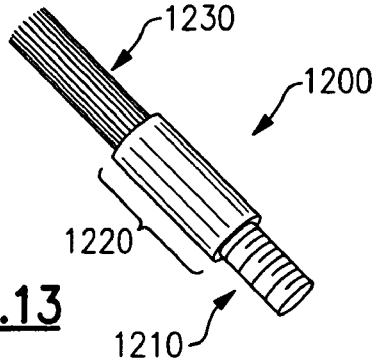
FIG. 13 is a perspective view of an end brush attachment for use with a firearm cleaning device of the present invention.
Figures 18, 19:
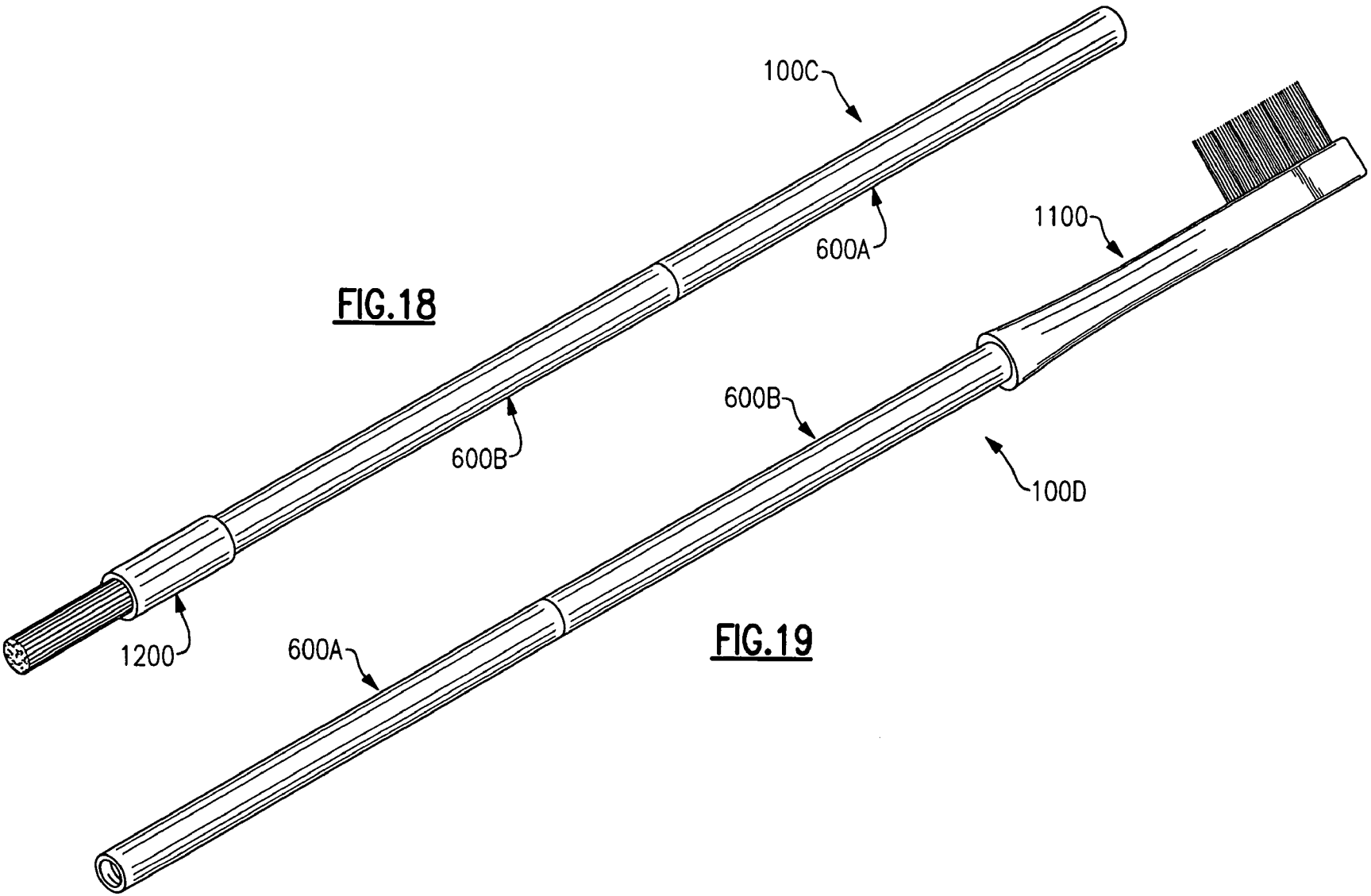
FIG. 18 is a perspective view of a firearm cleaning device in accordance with the present invention wherein the male rod of FIG. 15 and the female rod of FIG. 16 have been connected and the end brush attachment of FIG. 13 has been connected to the female rod.
FIG. 19 is a perspective view of a firearm cleaning device in accordance with the present invention wherein the male rod of FIG. 15 and the female rod of FIG. 16 have been connected and the side brush attachment of FIG. 12 has been connected to the female rod.

FIG. 18 depicts a cleaning device 100C that is formed from a male rod 600A, a female rod 600B and an end brush attachment 1200 (see FIG. 13), and FIG. 19 depicts a cleaning device 100D that is formed from a male rod 600A, a female rod 600B and a side brush attachment 1100 (see FIG. 12). Other attachments that can be connected to the female rod 600B to form a cleaning device 100*x* include, but are not limited to, a scraper attachment 900 (see FIG. 10) and a pick attachment 1000 (see FIG. 11).

In contrast to the devices 100A, 100B utilized during the three above-described cleaning steps, the cleaning devices 100C, 100D, . . . 100*x* are generally utilized by being inserted into the firing end of a firearm. However, the devices 100C, 100D, . . . 100*x* can be utilized identically to devices 100A, 100B as well, in which case it is currently preferred to form the device by connecting an attachment to the cable segment 200 rather than the one or more rods 600.

The specific choice of which attachment(s) to utilize in order to form the devices 100C, 100D, . . . 100*x* will vary depending on several factors, including, but not limited to, the type of firearm being cleaned, the type of material sought to be cleaned, and the level of cleaning sought to be achieved. By way of non-limiting example, the side brush attachment 1100 can be utilized for stripping away materials that have built up near the firing end of the barrel, as can the scraper attachment 1100, which is particularly effective for eliminating carbon, copper and plastic materials.

FIGS. 3-17 depict various components and attachments that can be utilized to form one or more of the cleaning devices 100A, 100B, 100C, 100D, . . . 100*x* of the present invention or which can be used in connection with a firearm barrel cleaning process of the present invention. Any or all of these components or attachments can be included within a kit. By way of non-limiting example, the kit components can be housed within a container, such as a carrying case (not shown), such as generally described in U.S. Design Pat. No. D339,470 to Marks, the entirety of which is incorporated by reference. According to a currently preferred embodiment of the present invention, the kit will include at least one of each of the components/attachments described herein, and, as is currently more preferred, will include at least two cable segments 200 and a plurality of patches 500. The kit also can include product literature, such as, by way of non-limiting example, an inventory of components list, one or more advertisements, one or more coupons, and one or more warranties. According to a currently preferred embodiment of the present invention, the kit literature will include at least instructions for assembling the different configurations of the cleaning device 100A, 100B, 100C, 100D, . . . 100*x* and for using the devices. The literature can be provided on hard copy (e.g., on paper or laminate) and/or on soft copy (e.g., a CD-ROM or another computer readable medium).

According to a currently preferred embodiment of the present invention, the container in which the kit is housed should be portable and lightweight, yet sturdy, and substantially waterproof. A suitable container is commercially available from Otis Products Inc. of Lyons Falls, N.Y.

Although the components and attachments in FIGS. 3-17 are illustrated with certain shapes, sizes and/or dimensions it should be understood any or all of these aspects of such components and attachments can vary from those shown. Among the factors that could prompt such variation are: the type of firearm, the size, shape and/or dimensions of the firearm, the size, shape and/or dimensions of the firearm barrel, the material(s) from which the components are made, and the intended usage environment(s) of the firearm cleaning device (e.g., when, where and how often the firearm cleaning device is intended to be used).

For example, the length of the cable segment 200 can vary according to a number of factors, including the type of firearm being cleaned. In a currently preferred embodiment of the present invention, a kit will include at least two cable segments 200 of different lengths, wherein the length of a first segment is about 30.0 inches and the length of a second segment is about 12.0 inches.

The cable segment(s) 200 should be flexible to allow for easy maneuvering through the firearm barrel, yet durable to ensure that the cable does not break or become frayed during the cleaning process. The material from which the cable segment(s) 200 can be made also can vary; however, to allow for both flexibility and durability, and according to a currently preferred embodiment of the present invention, each cable segment 200 is comprised of a metal-based core surrounded by a plastic-based outer layer. By way of non-limiting example, the cable segment(s) 200 can be made of the same materials from which the flexible shaft of the gun barrel cleaner described in U.S. Pat. No. 4,716,673 to Williams et al. are constructed.

The arbor 300 can be made of various materials, including but not limited to metallic-based materials and alloys thereof. According to a currently preferred embodiment of the present invention, the arbor is made of brass (e.g., alloy 360 brass). The diameter of the cylindrical end 330 of the arbor 300 generally is equal to about 150% of the diameter of the stem, and the length of the cylindrical end is generally about 20% of the overall length of the arbor 300. In a currently preferred embodiment of the present invention, the diameter of the cylindrical end 330 of the arbor 300 is about 0.75 inch and the diameter of the stem 310 is about 0.49 inch, whereas the length of the cylindrical end is about 0.25 inch and the overall length of the arbor is about 1.25 inch.

The width of the open end 340 portion of the stem 310 of the arbor 300 is generally less than about 50% of the diameter of the stem, wherein an open end width of about 0.21 inch is currently preferred. As illustrated in FIG. 4, the arbor has an internal bore 350 and a threaded internal portion 360 and a non-threaded internal portion 370. The length of the threaded portion 360 is generally less than about 50% of the length of the non-threaded portion 370, wherein currently preferred lengths of the threaded portion and the non-threaded portion are about 0.33 inch and about 0.82 inch respectively.

The grommet 710 and bristles 720 of each brush wheel 700 are generally made of different materials. A currently preferred material for the grommet is a metallic-based material (e.g., stainless steel, brass), and currently preferred materials for the brush body are filament-based materials, including, but not limited to, nylon (e.g., 0.010 nylon) and cubic boron nitride (0.016 CBN).

Although the brush wheel 700 is depicted and described herein as being circular, it can have other shapes as well (e.g., square, elliptical). The combined diameter of the grommet 710 and the opening 730 of the grommet generally accounts for about 50% of the overall diameter of the brush wheel 700 (including the bristles 720), wherein according to a currently preferred embodiment of the present invention, the overall diameter of the brush wheel (including the bristles) is about 1.75 inch and the combined grommet and opening diameter is about 0.91. The diameter of the opening 730 of each brush wheel 700 is approximately equal to, but slightly greater than the diameter of the arbor stem 310 so as to allow the brush wheel opening to fit over the stem. According to a currently preferred embodiment of the present invention, the diameter of the brush wheel opening 730 is about 0.50 inch.

The thicknesses of the grommet 710 and the bristle portion 720 of the brush wheel 700 are generally similar; however, according to a currently preferred embodiment of the present invention, the grommet is about 10% to 15% thicker than the bristle portion 720 of the brush wheel, wherein the thickness of the grommet is about 0.35 inch and the thickness of the bristle portion is about 0.31 inch.

The plug 400 can be made of a range of materials. According to a currently preferred embodiment of the present invention the plug is made of a resilient, durable, non-metallic material to minimize the possibility of the patch 500 becoming torn against the plug during the cleaning process. By way of non-limiting example, the plug 400 can be made from a rubber or plastic-based material.

The overall diameter of plug 400 is generally similar to, yet less than the overall diameter of the brush wheel 300, and the diameter of the plug opening 410 should be approximately equal to, but slightly greater than the diameter of the arbor stem 310 so as to allow the brush wheel opening to fit over the stem. According to a currently preferred embodiment of the present invention, the diameter of the plug 400 is about 1.67 inch and the diameter of the plug opening 410 is about 0.50 inch.

The overall thickness of the plug 400 is generally greater than the overall thickness of the brush wheel 700, and, as is currently preferred, is about 0.50 inch. The thickness of the cylindrical portion 420 of the plug 400 is generally equal to more than about 50% of the overall thickness of the plug, wherein a currently preferred thickness of the cylindrical portion is about 0.286 inch. The angle of bevel of the beveled or frusto-conical portion 430 can vary and even be a slightly rounded taper; however, according to a currently preferred embodiment of the present invention, the angle of bevel is about 45°.

Although the patch 500 is depicted and described herein as being round, it can have other shapes as well, including but not limited to elliptical and square. The patch 500 can be made of a range of materials, wherein the specific material should facilitate the ability of the patch to remove the materials that tend to accumulate within the barrel of the firearm. According to a currently preferred embodiment of the present invention, the patch is made of a fiber-based material, wherein a cotton-fiber based material is currently most preferred. The diameter of the patch 500 should be greater than the overall diameter of the plug 400, preferably by at least about 75%. According to a currently preferred embodiment of the present invention, the diameter of the patch 500 is about 3.0 inches. It should be noted, however, that a standard 2 inch military issue patch 500 can be used in accordance with the present invention as well. In such an embodiment, it would be necessary to create a hole within the patch 500.

As packaged within the kit, the patch(es) 500 can have no openings or one or more prefabricated openings. According to a currently preferred embodiment of the present invention, each of the patch(es) 500 within the kit should have at least one opening 510 defined therein to allow for placement of the patch over the stem 310 of the arbor 300. As is also currently preferred, the patch(es) should have a plurality of differently located slits (not shown) into which a slotted cleaning tip (as described, e.g., in U.S. Pat. No. 4,716,673 to Williams et al.) can be inserted in furtherance of cleaning one or more different types of firearms. Even if not utilized as such, the slits will not cause the patch 500 to tear, nor will they inhibit the cleaning efficacy of the patch.

The bore reflector 800 has a substantially straight main body 810 and a curved portion 820 so as to form a shape similar to a "candy cane." The bore reflector 800 should be formed of a material that allows one to utilize the reflector as an aid during visual examination of the firearm barrel. Suitable such materials include but are not limited to polymer-based materials such as resin materials. According to a currently preferred embodiment of the present invention the bore reflector is made of a polycarbonate resin, such as fiber optic LEXAN®, which is commercially available from GE Plastics of Pittsfield, Mass. USA.

The overall length of the bore reflector 800 is generally at least twice at much as its overall width, wherein according to a currently preferred embodiment of the present invention the bore length and width are about 2.15 inches and about 0.96 inch respectively. The width of the main body 810 of the bore reflector 800 is generally less than one-third of the overall width of the bore reflector 800, with a main body width of about 0.31 being currently preferred. The length of the main body 810 is generally at least about 75% of the overall length of the bore reflector 800, with a main body length of about 1.68 inch being currently preferred.

The scraper attachment 900 and the pick attachment 1000 are generally made of the same material, with a metal-based material being currently preferred. Among the suitable materials from which the scraper attachment 900 and the pick attachment 1000 can be constructed are brass (e.g., 360½ HD brass). It is also currently preferred for both the scraper 900 attachment and the pick attachment 100 to have an outer coating layer, wherein a metal-based coating is preferred in both instances. Among the suitable coating materials are copper (e.g., black copper).

The scraper attachment 900 has a main body 910 and a threaded stem 920, wherein the length of the main body is generally at least 75% of the overall length of the scraper attachment, with the length of the threaded stem comprising the remaining length. According to a currently preferred embodiment of the present invention, the overall length of the scraper attachment 900 is about 1.874 inch and the length of the main body 910 is about 1.61 inch.

The pick attachment 1000 has a main body 1010, a threaded stem 1020 and an elongate tip 1030, wherein the main body can include a textured (e.g., knurled) portion 1040. The length of both the main body 1010 is generally greater than that of the elongate tip and generally comprises at least about 50% of the overall length of the pick attachment 1000. The length of the elongate tip 1030, in turn, is generally at least about 50% greater than the length of the threaded stem 1020. According to a currently preferred embodiment of the present invention, the overall length of the pick attachment 1000 is about 1.9175 inch, wherein the lengths of the main body 1010, the threaded stem 1020 and the elongate tip 1030 are about 0.967 inch, 0.6875 inch and about 0.264 inch respectively.

The side brush component 1100 includes a threaded stem 1110 and a main body 1120, from which a plurality of bristles 1130 extend lengthwise in a direction substantially perpendicular to the main body. The side brush bristles 1130 are made from a filament-based material different that the material from which the brush wheel bristles 730 are made. The main body 1120 and the stem 1110 are generally made from different material, wherein according to a currently preferred embodiment of the present invention the main body is made of a plastic material, and the threaded stem is made of a metal-based material.

The length of both the main body 1120 generally comprises at least about 80% of the overall length of the side brush component 1100, with the length of the threaded stem 1110 comprising the remaining length. According to a currently preferred embodiment of the present invention, the overall length of the side brush attachment 1100 is about 2.69 inches and the length of the main body 1210 is about 2.35 inches.

The overall width of the side brush attachment 1100 consists of the width of the main body 1120 plus the protruding length of the bristles 1130. The protruding length of the bristles 1130 generally comprises at least about 50% of the overall width of the side brush attachment 1100. According to a currently preferred embodiment of the present invention, the overall width of the side brush attachment 1100 is about 0.61 inch and the protruding length of the bristles 1130 is about 0.34 inch.

The end brush attachment 1200 includes a threaded stem 1210 and a main body 1220, from which a plurality of bristles 1230 extend lengthwise in a direction substantially parallel to the main body. The end brush bristles 1230 are made from a filament-based material different that the material from which either the brush wheel bristles 730 or the side brush bristles 1130 are made. The main body 1220 and the stem 1210 of the end brush attachment 1200 are generally made from the same material, which, according to a currently preferred embodiment of the present invention, is a metal-based material (e.g., 360½ HD brass). As is also currently preferred, the main body 1220 of the end brush component 1200 is coated with a metal-based material. Among the suitable coating materials is copper (e.g., black copper).

The length of the main body 1220 and the length of the bristles 1230 are similar, and are generally slightly less than about twice as much as the length of the threaded stem 1210. According to a currently preferred embodiment of the present invention, the overall length of the end brush attachment 1200 is about 1.25 inches, wherein the lengths of the main body 1220, the threaded stem 1210 and the bristles 1230 are about 0.487 inch, about 0.263 inch and about 0.5 inch respectively.

The male rod 600A and the female rod 600B are generally made of the same materials, wherein a currently preferred material is a metal-based material. Suitable metal-based materials include, but are not limited to brass (e.g., 360½ HD brass). The diameters of the male rod 600A and the female rod 600B are substantially equal, and the length of the male rod is slightly greater than that of the female rod. According to a currently preferred embodiment of the present invention, the diameter of the male and female rods 600A, 600B are about 0.203 inch and their lengths are about 3.499 inches and about 3.25 inches respectively.

The centerpiece 120 is generally made of a metal-based material, wherein a currently preferred metal-based material is brass (e.g., 360½ HD brass). As is also currently preferred, the centerpiece (with the exception of ends 130, 150) is coated with a metal-based material. Among the suitable coating materials is copper (e.g., black copper). The diameter of the bore 140 should be similar to, but slightly greater than the diameters of the male and female rods 600A, 600B and less than the diameter of the end 130. Also, the diameter of the bore 140 is generally less than about 25% of the overall length of the centerpiece 120. According to a currently preferred embodiment of the present invention, the diameters of the bore 140 and the end 130 are about 0.205 inch and about 0.313 inch respectively, and the overall length of the centerpiece 120 is about 0.93 inch.

The cleaning devices 100A, 100B, 100C of the present invention can be used to clean all firearms, however, they are particularly suited for cleaning certain military issue weapons, which heretofore required complicated and time consuming disassembly and reassembly to ensure adequate cleaning. Among the military issue weapons that can be cleaned by one or more of the devices 100A, 100B, 100C, 100D, . . . 100*x* of the present invention are the so-called 40 mm series, including, but not limited to the HK GMG 40 mm, the M203, and the MK19 40 mm grenade launcher.

Although the present invention has been described herein with reference to details of currently preferred embodiments, it is not intended that such details be regarded as limiting the scope of the invention, except as and to the extent that they are included in the following claims—that is, the foregoing description of the present invention is merely illustrative, and it should be understood that variations and modifications can be effected without departing from the scope or spirit of the invention as set forth in the following claims. Moreover, any document(s) mentioned herein are incorporated by reference in their entirety, as are any other documents that are referenced within the document(s) mentioned herein.

I claim:

1. A configurable firearm barrel cleaning device, comprising:

at least one cable segment, wherein each cable segment has a first end and a second end;

an arbor having a stem with an first end operatively engagable with the first end of the cable segment and the arbor having a second end;

a plug having an opening defined therein, wherein the plug has a cylindrical portion and a beveled portion, the cylindrical portion being in communication with the second end of the arbor and the beveled portion being in communication with the patch;

at least one patch having an opening defined therein; and at least one brush wheel having an opening defined therein;

the cleaning device having a first configuration associated with at least a first cleaning operation, the first configuration being arranged such that:

the stem of the arbor is placed through the opening of the patch and through the opening of the plug, wherein the plug is in communication with both the second end of the arbor and with the patch, and the first end of the cable segment is connected to the arbor at the first end of the stem; and the cleaning device having a second configuration associated with at least a second cleaning operation, the second configuration being arranged such that:

the stem of the arbor is placed through the opening of each of the at least one brush wheel, wherein one brush wheel is in communication with the second end of the arbor; and the first end of the cable segment is connected to the arbor at the first end of the stem.

2. The device of claim 1, wherein the device includes a handle for use in at least one of the first and second configurations, the handle comprising:

a centerpiece connected to the second end of the cable segment, the centerpiece having a transverse bore; and at least one rod placed within the transverse bore of the centerpiece.

3. The device of claim 1, wherein at least one flange extends outwardly from the stem of the arbor.

4. The device of claim 1, wherein the device includes at least two brush wheels in the second configuration.

5. The device of claim 1, wherein each of the at least one brush wheel has a grommet that surrounds the opening and a plurality of bristles that extend from the grommet.

6. The device of claim 1, further comprising at least one attachment and at least one rod, and wherein the device has at least a third configuration in which the at least one attachment is connected to at least one rod.

7. The device of claim 6, wherein each of the at least one attachment is selected from the group consisting of at least one brush attachment, at least one scraper attachment and at least one pick attachment.

8. The device of claim 7, wherein each of the at least one brush attachment is selected from the group consisting of at least one side brush attachment and at least one end brush attachment.

9. The device of claim 1, wherein the first configuration of the device is further associated with a third cleaning operation.

10. A method of cleaning a firearm barrel, comprising the steps of:

providing a first configuration of a firearm cleaning device in which a stem of an arbor is placed through an opening defined in a patch and an opening defined in a plug having a cylindrical portion and a beveled portion, such that the cylindrical portion of the plug is in communication with the second end of the arbor and the beveled portion with the patch and such that a first end of a cable segment is connected to the arbor at the first end of the stem;

utilizing the first configuration of the firearm cleaning device to perform a first cleaning process comprising the steps of:

introducing a second end of the cable segment into the chamber of a firearm; and removing the second end of the cable segment from the firing end of the firearm; and pulling the device until the second end of the arbor emerges from the firing end of the firearm;

reconfiguring the first configuration of the firearm cleaning device into a second configuration of the firearm cleaning device in which the stem of the arbor is placed through an opening of each of at least one brush wheel, and such that the first end of the cable segment is connected to the arbor at the first end of the stem;

utilizing the second configuration of the firearm cleaning device to perform a second cleaning process comprising the steps of:

introducing the second end of the cable segment into the chamber of a firearm;

removing the second end of the cable segment from the firing end of the firearm; and pulling the device until the second end of the arbor emerges from the firing end of the firearm;

reconfiguring the second configuration of the firearm cleaning device into a third configuration;

utilizing the third configuration of the firearm cleaning device to perform a third cleaning process comprising the steps of:

introducing the second end of the cable segment into the chamber of a firearm;

removing the second end of the cable segment from the firing end of the firearm; and pulling the device until the second end of the arbor emerges from the firing end of the firearm.

11. The method of claim 10, wherein the third configuration of the firearm cleaning device is identical to the first configuration of the firearm cleaning device.

12. The method of claim 10, wherein a substance is applied to the patch prior to introducing the second end of the cable segment into the chamber of a firearm during the first cleaning process.

13. The method of claim 10, wherein the patch has a plurality of cleaning surfaces, and wherein a different surface of the patch is utilized during the first cleaning process as is used during the third cleaning process.

14. The method of claim 10, wherein the step of pulling the device until the second end of the arbor emerges from the firing end of the firearm is performed while applying torsional force to the device.

15. The method of claim 10, further comprising:

forming a handle for the firearm cleaning device, the handle being formed after removing the second end of the cable segment from the firing end of the firearm and being formed according to the steps of:

connecting a centerpiece to the second end of the cable segment after the second end of the cable segment has been removed from the firing end of the firearm; and placing at least one rod within a transverse bore of the centerpiece.

16. The method of claim 10, further comprising the steps of:

providing a fourth configuration of the firearm cleaning device in which at least one cleaning attachment is connected to a rod; and introducing the fourth configuration of the firearm cleaning device into the firearm.

17. The method of claim 16, wherein the fourth configuration of the firearm cleaning device is introduced into the firearm by introducing at least a portion of the cleaning attachment into the barrel of the firearm.

18. The method of claim 17, wherein each of the at least one attachment is selected from the group consisting of at least one brush attachment, at least one scraper attachment and at least one pick attachment.

19. A kit for containing components of a firearm cleaning device, the kit comprising:

at least one cable segment;

an arbor having a stem and one end adapted to be connected to a first end of the at least one cable segment;

a plug adapted to be placed over the stem of the arbor, wherein the plug has a cylindrical portion and a beveled portion, the cylindrical portion being in communication with the second end of the arbor and the beveled portion being in communication with the patch;

at least one patch; and at least one brush wheel adapted to be placed over the stem of the arbor.

20. The kit of claim 19, further comprising:

a centerpiece having a transverse bore and being adapted to be connected to a second end of the cable segment; and at least one rod adapted to be placed within the transverse bore of the centerpiece.

21. The kit of claim 20,further compromising:

at least one cleaning attachment, wherein each of the at least one cleaning attachment is adapted to be connected to at least one component selected from the group consisting of the at least cable segment and the at least one rod.

22. The kit of claim 21, wherein each of the at least one cleaning attachment is selected from the group consisting of at least one brush attachment, at least one scraper attachment and at least one pick attachment.

23. The kit of claim 20, further comprising:

a container of a predetermined quantity of a cleaning assistance substance.

24. The kit of claim 23, further comprising:

at least one piece of product literature.

25. The kit of claim 24, wherein each of the at least one piece of product literature is provided in a format selected from the group consisting of hard copy and soft copy.

* * * * *